US012201881B2

(12) United States Patent
Olson et al.

(10) Patent No.: US 12,201,881 B2
(45) Date of Patent: Jan. 21, 2025

(54) GOLF CLUB AND GOLF CLUB WEIGHT HOUSING

(71) Applicant: Sumitomo Rubber Industries, Ltd., Kobe (JP)

(72) Inventors: Tyler S. Olson, Huntington Beach, CA (US); Dustin J. Brekke, Fountain Valley, CA (US)

(73) Assignee: Sumitomo Rubber Industries, Ltd., Kobe (JP)

( * ) Notice: Subject to any disclaimer, the term of this patent is extended or adjusted under 35 U.S.C. 154(b) by 425 days.

(21) Appl. No.: 17/566,502

(22) Filed: Dec. 30, 2021

(65) Prior Publication Data

US 2023/0211214 A1 Jul. 6, 2023

(51) Int. Cl.
*A63B 53/08* (2015.01)
*A63B 53/14* (2015.01)

(52) U.S. Cl.
CPC ..... *A63B 53/08* (2013.01); *A63B 53/14* (2013.01); *A63B 2209/00* (2013.01)

(58) Field of Classification Search
CPC ..... A63B 53/14; A63B 53/08; F16B 7/02
See application file for complete search history.

(56) References Cited

U.S. PATENT DOCUMENTS

| | | | | |
|---|---|---|---|---|
| 7,481,716 | B1 * | 1/2009 | Johnson | A63B 60/24 473/297 |
| 8,956,238 | B2 | 2/2015 | Boyd et al. | |
| 9,216,325 | B2 * | 12/2015 | Vald'Via | F16L 55/1141 |
| 9,333,390 | B1 | 5/2016 | Manwaring et al. | |
| 9,616,307 | B1 * | 4/2017 | Chiang | A63B 53/14 |
| 9,694,265 | B2 | 7/2017 | Margoles et al. | |
| 11,020,635 | B2 | 6/2021 | Dolezel et al. | |
| 2003/0207720 | A1 | 11/2003 | Sery | |
| 2017/0182389 | A1 * | 6/2017 | Golden | A63B 60/24 |
| 2020/0338408 | A1 * | 10/2020 | Takeuchi | A63B 60/14 |
| 2021/0154544 | A1 * | 5/2021 | Milleman | A63B 53/007 |
| 2023/0001275 | A1 * | 1/2023 | Kobayashi | A63B 60/24 |
| 2023/0057922 | A1 * | 2/2023 | Johnston | A63B 60/02 |

FOREIGN PATENT DOCUMENTS

WO WO-2005061058 A1 * 7/2005 ..... A63B 53/14

* cited by examiner

*Primary Examiner* — Joshua T Kennedy
(74) *Attorney, Agent, or Firm* — Barry IP Law, P.C.

(57) ABSTRACT

A golf tip plug housing includes an exterior surface configured to be securably affixed to a butt end of a golf club shaft and an interior surface configured to securably receive a golf tip plug having an outer diameter of either: (a) 7.0 mm-7.6 mm or (b) 4.0 mm-4.6 mm. In one aspect, a golf club includes a head and a shaft having a tip end attached to the head and a butt end opposite the tip end. A tip plug includes a stem and a head. The tip plug stem has an outer diameter sized to be insertable in the tip end. A tip plug housing has an outer diameter sized to be insertable in the butt end and an inner diameter sized to receive the tip plug. The tip plug is positioned in the tip plug housing and the tip plug housing is positioned in the butt end.

23 Claims, 7 Drawing Sheets

GOLF CLUB AND GOLF CLUB WEIGHT HOUSING

BACKGROUND

Weight distribution in a golf club is an important parameter that can significantly affect performance. A golf club fitter may match a golfer's particular swing tendencies with a specific golf club shaft to optimize the weight distribution of a particular golf club. As an alternative to a customized shaft for each individual golf club, which can be costly and labor intensive, weight distribution may be controlled during golf club assembly by adding or removing mass to one or both ends of the golf club's shaft to tune various golf club properties, such as, for example, the golf club's swingweight, balance point, or club moment of inertia. Mass can be removed from a golf club shaft by, for example, trimming the shaft's tip end.

But adding mass to a particular location of the golf club shaft during golf club assembly typically requires inserts or plugs that are specifically sized to either the shaft's tip end or butt end. Because a conventional golf club shaft is wider at its butt end than its tip end, a weight plug sized to be insertable in the butt end of the shaft is generally too large to fit into the tip end and vice-versa. Thus, a golf club assembler needs to have one set of plugs of one outer diameter to add weight to the butt end and a second set of smaller outer diameter plugs to add weight to the tip end. Furthermore, additional plug sizes may be necessary to accommodate different types of golf club shafts. For example, steel shafts may generally require larger diameter tip plugs than graphite shafts.

Additionally, customizable golf clubs that allow for adjustments to suit a golfer's swing tendencies or playing conditions have become popular. For example, golf club heads may be available with interchangeable or movable weights, and some golf club manufacturers offer interchangeable shaft weighting with, for example, inserts that couple with the club's grip. However, such weighting systems are usually specific to and limited to a specific golf club model or manufacturer. Alternatively, a golfer can apply varying amounts of lead tape to add weight to a golf club head or the shaft, which can be imprecise and aesthetically unappealing.

SUMMARY

The present inventors recognized a need for a more universal weighting system that would help streamline the golf club manufacturing processes and offer golf club customizability. The golf tip plug housings disclosed herein and the disclosed methods of assembling the same with golf clubs allow for a standard sized golf tip plug to be used for a wide variety of golf clubs at both the tip end of the shaft and at the butt end of the shaft. This advantageously decreases the cost and complexity of customizing the weight distribution of the shaft as compared to conventional methods using different sized golf tip plugs that are specific to and limited to a specific golf club model or manufacturer, while providing a more precise and aesthetic weighting than lead tape.

In one or more aspects of the disclosure, a golf club includes a golf club head and a golf club shaft that has a tip end attached to the club head. The shaft has a butt end opposite the tip end that has an inner diameter greater than the inner diameter of the tip end. A golf club grip is installed over the butt end of the shaft. A tip plug includes a stem and a head located at one end of the stem with the tip plug stem having an outer diameter sized to be insertable in the tip end of the shaft. A tip plug housing or adapter has an outer diameter sized to be insertable in the butt end of the shaft and an inner diameter sized to receive the tip plug. The tip plug is positioned in the tip plug housing and the tip plug housing is positioned in the butt end of the shaft.

In some aspects, the golf tip plug housing or adapter includes an exterior surface configured to be securably affixed to a butt end of a golf club shaft. An interior surface of the golf tip plug housing is configured to securably receive a golf tip plug having an outer diameter of either: (a) 7.0 mm to 7.6 mm; or (b) 4.0 mm to 4.6 mm.

In one or more aspects of the disclosure, a golf club comprises a golf club head including a port and a shaft having a tip end and a butt end. A weight assembly of the golf club includes an adapter or housing received in the port and a tip plug having a mass no less than 0.5 g. The tip plug is sized to be insertable into either of the tip end of the shaft or the adapter and includes a cover.

In some aspects, a method of assembling a golf club includes selecting a tip plug from a set of tip plugs having varying masses and inserting the selected tip plug into a tip plug housing or adapter. The tip plug housing is inserted into a butt end of a golf club shaft and the shaft is attached to a golf club head. A golf club grip is attached to the butt end of the shaft. Each tip plug in the set of tip plugs is sized to be insertable in a tip end of the golf club shaft.

According to other aspects, a method of modifying a golf club's swingweight comprises selecting a tip plug between a first tip plug having a first mass and a second tip plug having a second mass greater than the first mass. The selected tip plug is inserted into a tip plug housing or adapter and the tip plug housing is inserted into a butt end of a golf club shaft. The shaft is attached to a golf club head and a golf club grip is attached to the butt end of the shaft. Each of the two tip plugs is sized to be insertable in a tip end of the shaft. When the first tip plug is selected, the golf club has a first swingweight, and when the second tip plug is selected, the golf club has a second swingweight that is at least one swingweight unit less than the first swingweight.

The various exemplary aspects described above may be implemented individually or in various combinations. The foregoing features and advantages, as well as other features and advantages, of the golf clubs, golf tip plug housings, weight assemblies, and methods of assembling or modifying the same will become apparent to those of ordinary skill in the art after consideration of the following description, the accompanying drawings, and the appended claims.

BRIEF DESCRIPTION OF THE DRAWINGS

The features and advantages of the embodiments of the present disclosure will become more apparent from the detailed description set forth below when taken in conjunction with the drawings. The drawings and the associated descriptions are provided to illustrate embodiments of the disclosure, and not to limit the scope of what is claimed.

DETAILED DESCRIPTION

Representative examples of one or more novel and nonobvious aspects and features of the golf clubs, golf tip plug housings, weight assemblies, and methods of assembling or modifying the same as disclosed below are not intended to be limiting in any manner. Furthermore, the various aspects and features of the present disclosure may be used alone or in a variety of novel and nonobvious combinations and sub-combinations with one another.

Figure 1:
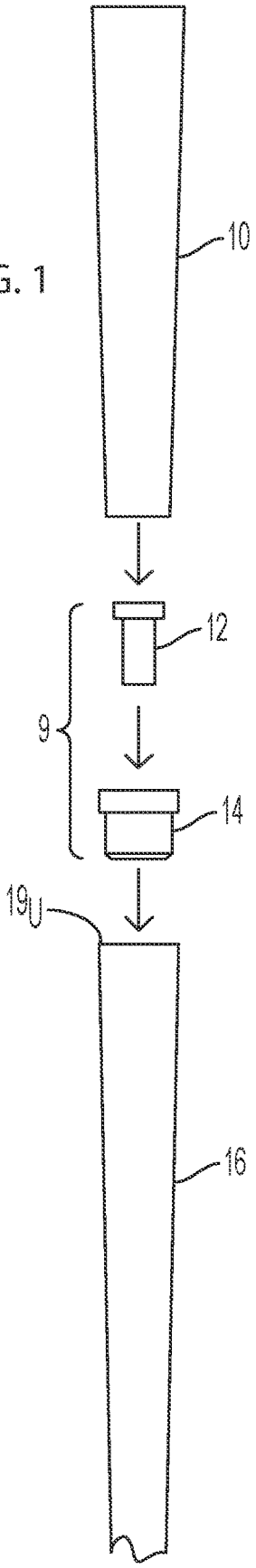
FIG. 1 is an exploded view of a golf club shaft, tip plug housing, tip plug, and grip according to one or more embodiments.

FIG. 1 is an exploded view of golf club shaft 16, golf tip plug housing or adapter 14, golf tip plug 12, and golf grip 10 according to one or more embodiments. As shown in FIG. 1, tip plug housing 14 has an outer diameter sized to be insertable into the butt end of golf club shaft 16 and an inner diameter sized to receive tip plug 12. The combination of tip plug 12 and tip plug housing 14 form weight assembly 9 configured to adjust the weight distribution of shaft 16. Grip 10 is installed over butt end 19*u* of shaft 16, which is opposite a tip end of shaft 16 (i.e., tip end $\mathbf{19}_L$ in FIG. 4).

As discussed in more detail below, tip plug housing 14 can allow for a tip plug configured to securably or snugly fit into the tip end of shaft 16 to also securably or snugly fit into butt end 19*u* despite the butt end of shaft 16 having a larger inner diameter than the inner diameter of the tip end of shaft 16. As a result, standard sized golf tip plugs can be used interchangeably in either the tip end or the butt end, thereby no longer requiring different sets of tip plugs for the butt end and the tip end. The tip plug housings disclosed herein can also allow the standard sized tip plugs to be used in different types of golf club shafts that previously would have required additional sets of tip plugs, such as for generally larger inner diameter steel shafts versus smaller inner diameter graphite shafts. In this regard, a larger outer diameter tip plug housing may be used for a first type of golf club shaft (e.g., a steel shaft) than for a second type of golf club shaft (e.g., a graphite shaft).

Moreover, the use of the disclosed tip plug housings or adapters can facilitate a standard sized tip plug that has an outer diameter of either: (a) 7.0 mm to 7.6 mm; or 4.0 mm to 4.6 mm. The mass of the standard sized tip plugs can then be varied by using different materials and/or by using different stem lengths that may extend by different distances into or past the tip plug housing through its inner diameter. In this regard, tip plug 12 can have a stem length (e.g., length of stem $\mathbf{15}_U$ or length of stem $\mathbf{15}_L$ in FIG. 4) no less than 1.5 mm and no greater than 25 mm. In some implementations, tip plug 12 can be chosen from a set of standard sized tip plugs that have varying lengths and/or are made from different materials to vary the mass of the tip plugs in the set. For example, tip plug 12 or one or more standard sized tip plugs in a set of tip plugs can comprise a material having a density no less than 5 g/cm$^3$, a density no less than 8 g/cm$^3$, and/or a density no less than 11 g/cm$^3$. The difference in masses among tip plugs in a standard sized set of tip plugs can vary, for example, by 3.5 g.

In addition, the outer diameter of the stem of tip plug 12 or a set of standard sized tip plugs can have a particular size corresponding to the inner diameter of a particular type of shaft. For example, club shaft 16 can include a graphite material and the outer diameter of the stem of tip plug 12 or standard sized tip plugs in a set of tip plugs for graphite shaft golf clubs can be no greater than 4.5 mm. As another example, club shaft 16 can include a steel material and the outer diameter of the stem of tip plug 12 or standard sized tip plugs in a set for steel shaft golf clubs can be no greater than 7.5 mm.

For its part, a mass of tip plug housing 14 also contributes to the overall mass of weight assembly 9. For example, tip plug housing 14 can comprise a mass no less than 1.0 g and no greater than 5.0 g, and preferably about 2.0 g.

Figure 2:
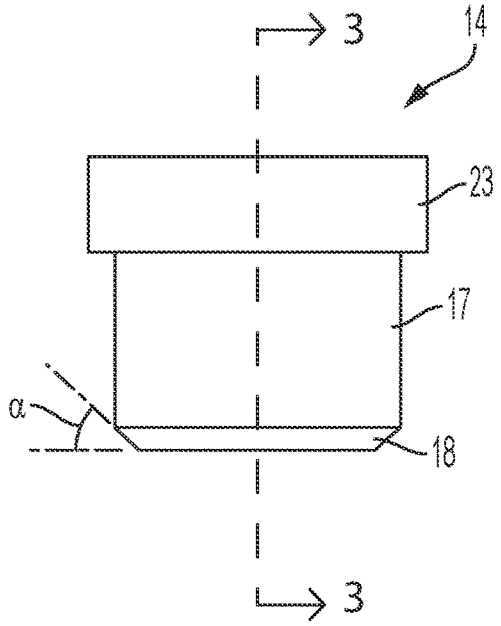
FIG. 2 is a front view of a tip plug housing according to one or more embodiments.

FIG. 2 is a front view of tip plug housing or adapter 14 according to one or more embodiments. As shown in FIG. 2, tip plug housing 14 includes upper portion 23 and a lower portion 17 with the outer diameter of upper portion 23 (i.e., $D_{UO}$ in FIG. 3) being greater than the outer diameter of lower portion 17 (i.e., $D_{LO}$ in FIG. 3). In some implementations, tip plug housing 14 can have a mass no less than 1.0 g and no greater than 5.0 g, and preferably about 2.0 g.

The example of tip plug housing 14 in FIG. 2 also includes outer surface 18 of lower portion 17 that is beveled. The beveled edge of the outer circumference of lower portion 17 in FIG. 2 is beveled at an angle $\alpha$ with respect to the bottom surface of tip plug housing 14, which is shown as horizontal in FIG. 2. The use of a beveled edge, such as outer surface 18, can advantageously accommodate manufacturing tolerances for an inner diameter of the tip end of the golf club shaft. The beveled edge can also make insertion of the tip plug housing into the butt end easier and help resist wear of the tip plug housing. Other implementations may not include a beveled lower edge though.

Tip plug housing 14 can be made from a resilient material by, for example, injection molding. In some implementations, tip plug housing 14 can include a material chosen from a plastic material (e.g., thermoplastic polyurethane (TPU), acrylonitrile butadiene styrene (ABS), or polyvinyl chloride (PVC)), a rubber material, and an elastomer material (e.g., silicone). In implementations where a plastic material is used for tip plug housing 14, the plastic material can be made of a TPU with a Shore A hardness of about 60 to 90, and preferably a Shore A hardness of about 70 to 80. In some implementations, tip plug housing 14 can comprise a material having a density no less than 1 g/cm$^3$.

Figure 3:
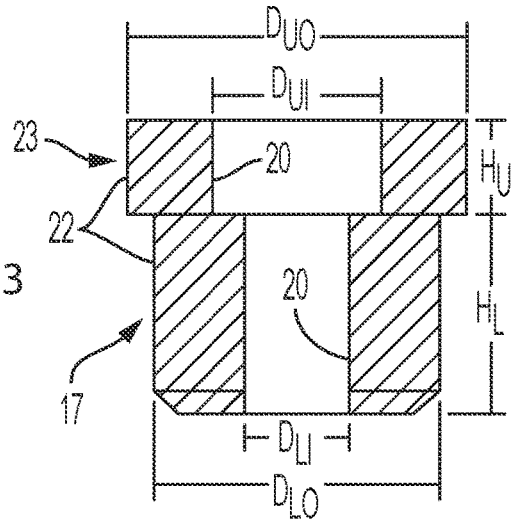
FIG. 3 is a cross-section view of the tip plug housing of FIG. 2 according to one or more embodiments.

FIG. 3 is a cross-section view of tip plug housing 14 across section line 3 in FIG. 2 according to one or more embodiments. As shown in FIG. 3, interior surface 20 of tip plug housing 14 is configured to securely or tightly receive a golf tip plug (e.g., tip plug 12 in FIG. 1). In this regard, the upper inner diameter Dui of upper portion 23 is greater than the lower inner diameter $D_{LI}$ of lower portion 17. The upper inner diameter Dui and the lower inner diameter $D_{LI}$ can be sized to accommodate a standard sized tip plug. For example, tip plugs for steel shaft golf clubs may have a standard sized outer diameter of approximately 8.45 mm for its head and a standard sized outer diameter of approximately 7.33 mm for its stem. As another example, tip plugs for graphite shaft golf clubs may have a standard sized outer diameter of approximately 7.5 mm for its head and a standard sized outer diameter of approximately 4.3 mm for its stem.

In addition, the interior height of upper portion 23 or upper portion height $H_U$ is configured to securely receive the head of a tip plug. In this regard, upper portion 23 can have a height $H_U$ that is no less than 2 mm, and preferably no less than 1.5 mm. The height of lower portion 17, $H_L$, can be sized to securely fit into an inner diameter of a golf club shaft. In some implementations, $H_L$ can be sized based at least in part on the lengths of the tip plugs for a secure fit. As noted above, the standard sized tip plugs may have stems of different lengths, some of which may extend through the center of the tip plug housing.

The outer diameters of the upper portion and lower portion of the tip plug housing 14 may be sized to securely fit or be securably affixed to the butt end of a golf club shaft. In some implementations, the outer diameter DUO of upper portion 23 can be approximately the same diameter as the outer diameter of the golf club shaft at its butt end. In this regard, DUO can be no less than 15 mm in some implementation. As shown in FIG. 1, golf grip 10 can fit over the exposed outer surface 22 of upper portion 23 of tip plug housing 14 and an exterior surface portion of shaft 16 near butt end 19U to secure tip plug housing 14 into place. In some implementations, a double-sided tape can be applied to butt end 19U of shaft 16 such that there is an overhang of tape (e.g., approximately 1 inch or more) past the butt end. After inserting tip plug housing 14 and tip plug 12 into butt end 19U, tip plug housing 14 and tip plug 12 can be secured by folding over the overhung tape onto tip plug housing 14 and tip plug 12. Double-sided tape may also be applied to extend down the shaft approximately the length of a golf club grip and further secure the golf club grip to the shaft.

Alternatively or additionally, an adhesive may be used to affix or secure tip plug housing 14 and/or a tip plug into place inside shaft 16, such as by applying the adhesive to an outer surface of the tip plug and/or to outer surface 22 of tip plug housing 14 at one or both of upper portion 23 and lower portion 17. Alternatively or additionally, tip plug housing 14 and/or a tip plug 12 may be frictionally secured or press fit into the shaft or tip plug housing, respectively. As discussed in more detail below with reference to FIGS. 7A to 7C, a tip plug housing can include one or more exterior surface protrusions, such as one or more expansion members, ribs, or threads to reduce movement or slipping of the tip plug housing out of the shaft.

In one or more embodiments, the butt end of a golf club grip (e.g., grip 10 in FIG. 1) may include a window or opening through which a tip plug can be removed and installed. Such a window may further facilitate a golf club's customizability by allowing a user to change the mass of the installed tip plug without removing and reinstalling the grip, which may be cumbersome.

Figure 4:
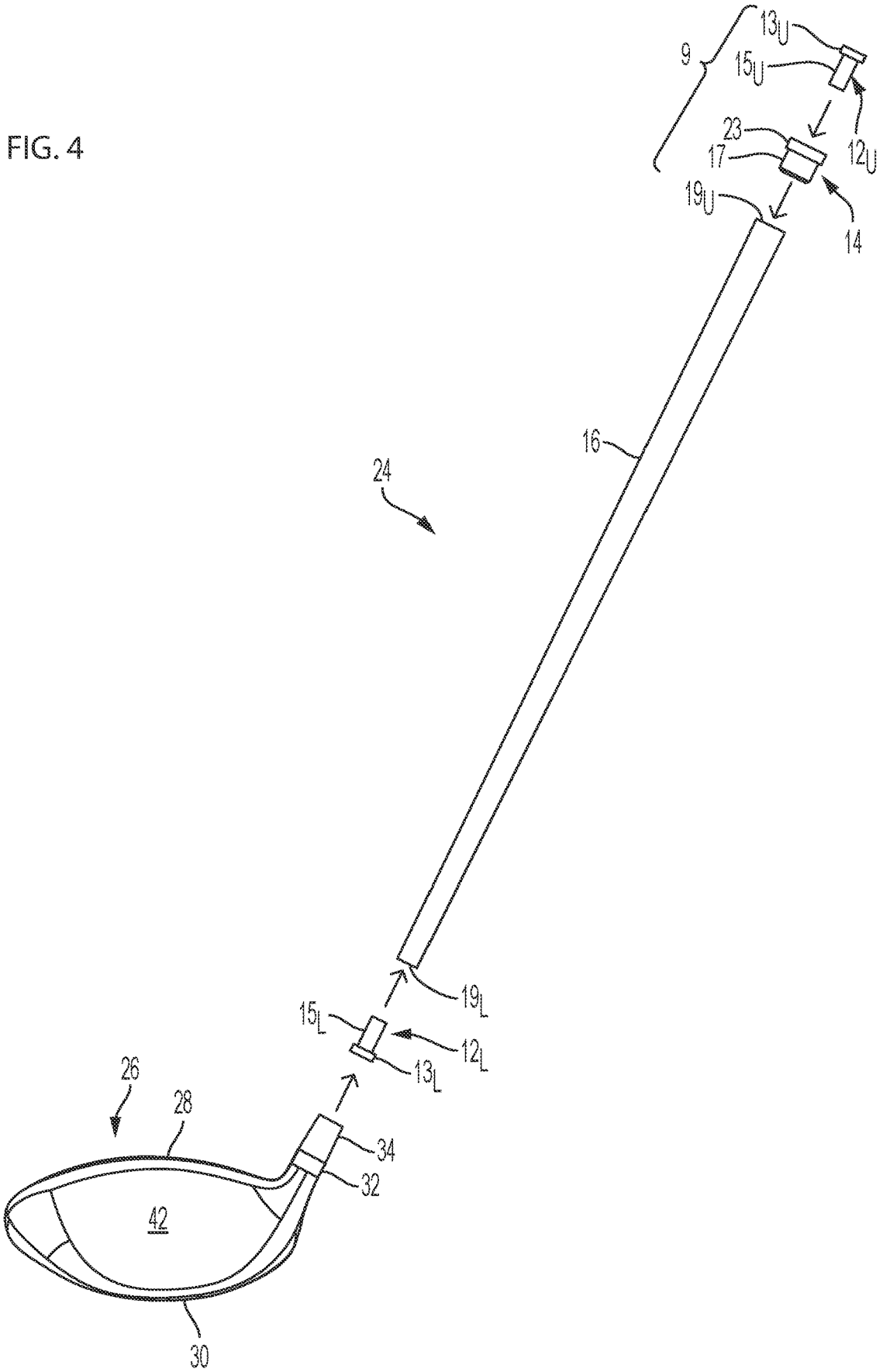
FIG. 4 is an exploded view of a golf club including a tip plug housing and two tip plugs according to one or more embodiments.

FIG. 4 is an exploded view of golf club 24 including lower tip plug $\mathbf{12}_L$ and tip plug housing 14 for receiving upper tip plug $\mathbf{12}_U$ according to one or more embodiments. In the example of FIG. 4, golf club 24 includes golf club head 26, golf club shaft 16, and a golf grip, which is not shown in FIG. 4. Shaft 16 includes tip end $\mathbf{19}_L$ that is attached to club head 26 by fitting into hosel 32 of club head 26. Ferrule 34 provides a transition between shaft 16 and hosel 32.

As shown in FIG. 4, club head 26 includes striking face 42 configured to contact a ball. In addition, club head 26 includes sole 30 on a bottom portion of club head 26 and crown 28 on a top portion of club head 26. Although club head 26 is depicted in FIG. 4 as having a metal-wood type golf club head, such as for a driver, wood, or hybrid club, tip plugs and the disclosed tip plug housings or adapters can be used with other types of golf clubs, such as with an iron, a wedge, or a putter.

Tip plug housing 14 has an outer diameter sized to be insertable in butt end $\mathbf{19}_U$ of shaft 16 and has at least one inner diameter sized to receive upper tip plug $\mathbf{12}_U$. As shown in FIG. 4, the combination of tip plug $\mathbf{12}_U$ and housing 14 forms weight assembly 9. The inner diameter of lower portion 17 of tip plug housing 14 is approximately the same size as the inner diameter of tip end $\mathbf{19}_L$ of shaft 16 to accommodate standard sized tip plugs, such as tip plugs $\mathbf{12}_U$ and $\mathbf{12}_L$, at either end of shaft 16. As discussed above, tip plugs $\mathbf{12}_U$ and $\mathbf{12}_L$ can be chosen from a set of standard sized tip plugs that have different masses such that tip plugs $\mathbf{12}_U$ and $\mathbf{12}_L$ have a difference in mass to customize the weight distribution of golf club 24 to a particular player, swing, club type, and/or playing condition.

In this regard, the outer diameter of the stems $\mathbf{15}_U$ and $\mathbf{15}_L$ of upper tip plug $\mathbf{12}_U$ and lower tip plug $\mathbf{12}_L$, respectively, is slightly smaller than the inner diameter of tip end $\mathbf{19}_L$ of shaft 16 and tip plug housing 14 to accommodate or fit the stems 15 of tip plugs 12. In addition, the inner diameter of upper portion 23 of tip plug housing 14 is slightly larger than the outer diameter of head $\mathbf{13}_U$ or $\mathbf{13}_L$, to accommodate or fit the heads 13 of tip plugs 12 into upper portion 23 of tip plug housing 14. The exterior of head $\mathbf{13}_U$, of tip plug $\mathbf{12}_L$, in the example of FIG. 4 can be exposed to an outer surface of shaft 16, which can be positioned into ferrule 34 and hosel 32 to secure shaft 16 to club head 26.

Those of ordinary skill in the art will appreciate with reference to the present disclosure that different arrangements of golf club 24 are possible in other implementations. For example, other implementations may not include lower tip plug $\mathbf{12}_L$, or may include a different type of club head for club head 26, such as an iron or a wedge club head.

Figure 5A:
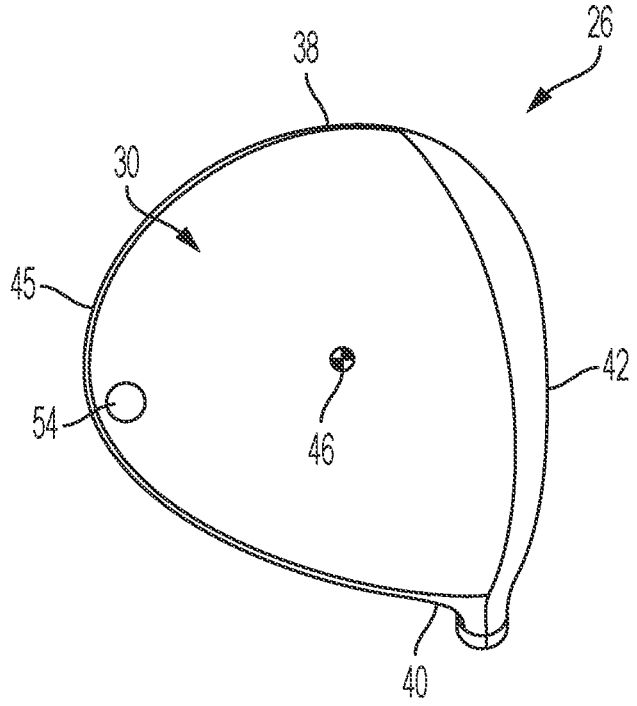
FIG. 5A is a bottom view of a golf club head including a weight assembly according to one or more embodiments.

FIG. 5A is a bottom view of sole 30 of golf club head 26 including weight assembly 54 according to one or more embodiments. Weight assembly 54 in the example of FIG. 5A is located near a rear portion 45 of club head 26, which can be beneficial for shifting the location of the Center of Gravity (CG) 46 of club head 26 rearward from striking face 42. For example, the addition of weight assembly 54 near rear portion 45 on sole 30 can locate CG 46 farther rearward from striking face 42 to increase a Moment of Inertia (MOI) about a vertical axis through CG 46 to make club head 26 more "forgiving" for off-center shots. The tuning of CG depth of a club head is also useful for correcting shot height and trajectory.

Figure 5B:
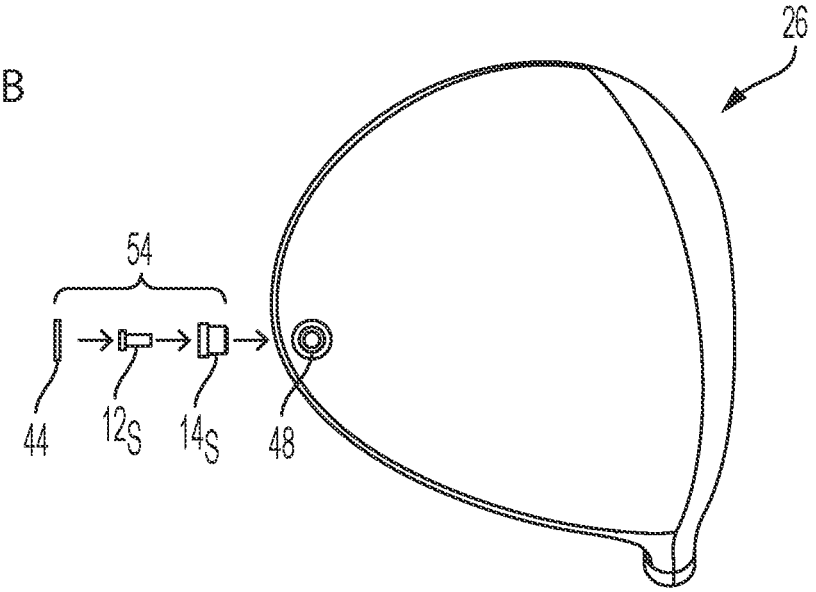
FIG. 5B is an exploded view of the weight assembly of FIG. 5A according to one or more embodiments.

FIG. 5B is an exploded view of weight assembly 54 from FIG. 5A according to one or more embodiments. As shown in FIG. 5B, weight assembly 54 includes tip plug housing or adapter $\mathbf{14}_S$, tip plug $\mathbf{12}_S$, and cover or cap 44. Tip plug housing $\mathbf{14}_S$ is configured to fit into port or opening 48 in sole 30 of club head 26 and is further configured to securely receive tip plug $\mathbf{12}_S$, which may be selected from a set of standard sized tip plugs having varying masses. In some implementations, tip plug housing $\mathbf{14}_S$ can have the same dimensions as a tip plug housing used to fit into the butt end of a shaft, such as tip plug housing 14 discussed above with reference to FIGS. 1 to 4. For example, tip plug housing $\mathbf{14}_S$ can accommodate a standard sized tip plug that has an outer diameter of either: (a) 7.0 mm to 7.6 mm; or 4.0 mm to 4.6 mm. In some cases, tip plug housing $\mathbf{14}_S$ may have an upper portion inner diameter and a lower portion inner diameter (e.g., $D_{UI}$ and $D_{LI}$ in FIG. 3) that can accommodate a standard sized tip plug, but the outer diameters of the upper portion and lower portion (e.g., $D_{UO}$ and $D_{LO}$) of the tip plug housing may differ from a tip plug housing used in the butt end of a golf shaft. However, as noted above, tip plug housing $\mathbf{14}_S$ in some implementations may have the same outer diameters as a tip plug housing used to fit into the butt end of a golf shaft.

The mass of the standard sized tip plugs, such as $\mathbf{12}_S$, can vary by using different materials and/or by using different stem lengths that may extend by different distances into or past the tip plug housing $\mathbf{14}_S$ through its inner diameter. In some implementations, tip plug $\mathbf{12}_S$ can have a stem length (e.g., length of stem $\mathbf{15}_U$ or length of stem $\mathbf{15}_L$ in FIG. 4) no less than 1.5 mm and no greater than 25 mm. In some implementations, tip plug $\mathbf{12}_S$ can be chosen from a set of standard sized tip plugs that have varying lengths and/or are made from different materials to vary the mass of the tip plugs in the set. For example, tip plug $\mathbf{12}_S$ or one or more standard sized tip plugs in a set of tip plugs can comprise a material having a density no less than 5 g/cm$^3$, a density no less than 8 g/cm$^3$, and/or a density no less than 11 g/cm$^3$. The difference in masses among tip plugs in a standard sized set of tip plugs can vary, for example, by 3.5 g.

For its part, a mass of tip plug housing $\mathbf{14}_S$ also contributes to the overall mass of weight assembly 54. For example, tip plug housing $\mathbf{14}_S$ can comprise a mass no less than 1.0 g and no greater than 5.0 g, and preferably about 2.0 g. The arrangement of tip plug housing $\mathbf{14}_S$ in weight assembly 54 can allow for standard sized tip plugs 12 not just to be used for distributing weight in a golf shaft but can also allow the same standard sized tip plugs 12 to be used for distributing weight in a golf club head. This can further simplify and reduce the cost for a customized weight distribution for a golf club head since the same set of tip plugs can be used in different locations due to tip plug housings 14.

However, even in implementations where tip plug housing $\mathbf{14}_S$ in FIG. 5A may not be interchangeable with tip plug housings configured to be inserted into a butt end of a club shaft (e.g., tip plug housing 14 in FIGS. 1 and 4), tip plug housing $\mathbf{14}_S$ can still have inner dimensions to accommodate a standard sized tip plug used to distribute mass in a golf shaft. Similarly, tip plug $\mathbf{12}_S$ in FIG. 5A in some implementations may not be interchangeable with tip plugs configured to be inserted into a butt end or tip end of a club shaft (e.g., tip plugs $\mathbf{12}_U$ and $\mathbf{12}_L$ in FIG. 4). In yet other implementations, tip plug housing $\mathbf{14}_S$ may not be included in weight assembly 54. In such implementations, port or opening 48 can be sized to receive tip plug $\mathbf{12}_S$ and cover 44.

Figure 6A:
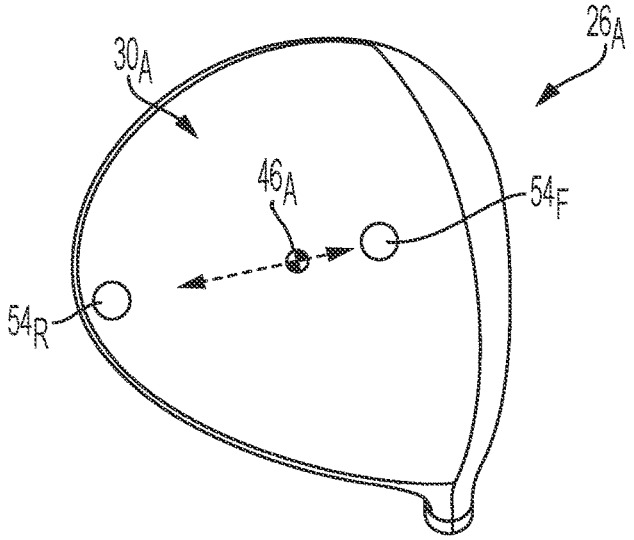
FIG. 6A is a bottom view of a golf club head indicating rearward and forward weight assembly locations for adjusting a center of gravity depth location according to one or more embodiments.

FIG. 6A is a bottom view of golf club head $\mathbf{26}_A$ indicating rearward and forward weight assembly locations for adjusting a center of gravity depth location according to one or more embodiments. As shown in FIG. 6A, a weight assembly, such as weight assembly 54 in FIG. 5B, can be located on sole $\mathbf{30}_A$ of club head $\mathbf{26}_A$ in a forward position $\mathbf{54}_F$ or in a rearward position $\mathbf{54}_R$ to shift the location of CG $\mathbf{46}_A$ forward or rearward, respectively.

Figure 6B:
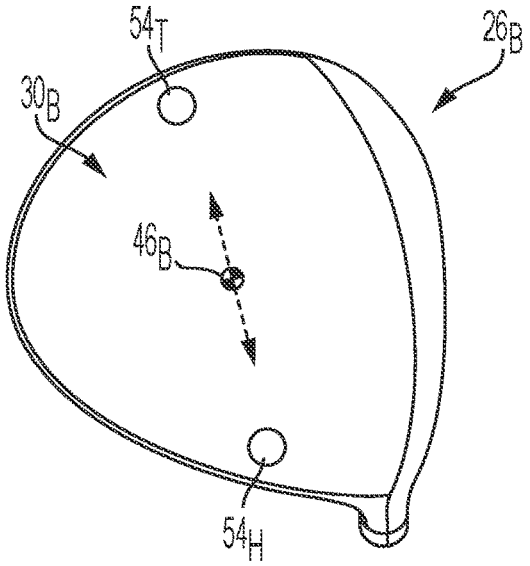
FIG. 6B is a bottom view of a golf club head indicating toeward and heelward weight assembly locations for adjusting a center of gravity lateral location according to one or more embodiments.

FIG. 6B is a bottom view of golf club head $\mathbf{26}_B$ indicating toeward and heelward weight assembly locations for adjusting a center of gravity lateral location according to one or more embodiments. As shown in FIG. 6B, a weight assembly, such as weight assembly 54 in FIG. 5B, can be located on sole $\mathbf{30}_B$ of club head $\mathbf{26}_B$ in a toeward position $\mathbf{54}_T$ or in a heelward position $\mathbf{54}_H$ to shift the location of CG $\mathbf{46}_B$ toeward or heelward, respectively.

Figure 6C:
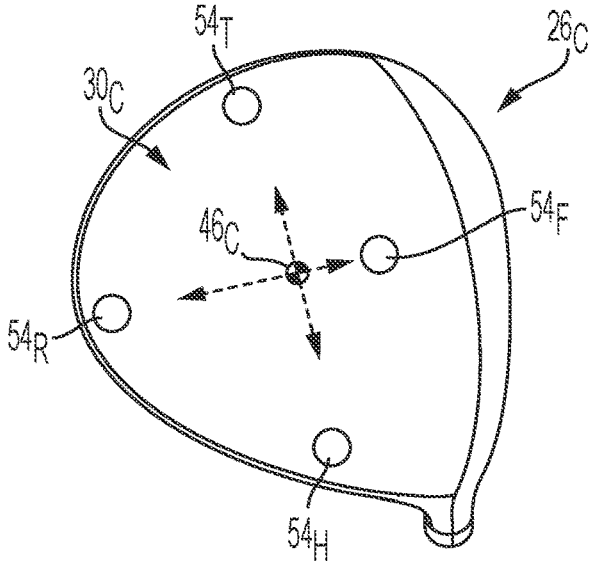
FIG. 6C is a bottom view of a golf club head indicating rearward, forward, toeward, and heelward weight assembly locations for adjusting a center of gravity location according to one or more embodiments.

FIG. 6C is a bottom view of golf club head $\mathbf{26}_C$ indicating rearward, forward, toeward, and heelward weight assembly locations for adjusting a center of gravity location according to one or more embodiments. As shown in the example of FIG. 6B, a weight assembly, such as weight assembly 54 in FIG. 5B, can be located on sole $\mathbf{30}_C$ of club head $\mathbf{26}_C$ in toeward position $\mathbf{54}_T$ or in a heelward position $\mathbf{54}_H$ to shift the location of CG $\mathbf{46}_C$ toeward or heelward, respectively. In addition, a second weight assembly, such as weight assembly 54 in FIG. 5B, can be located on sole $\mathbf{30}_C$ of club head $\mathbf{26}_C$ in a forward position $\mathbf{54}_F$ or in a rearward position $\mathbf{54}_R$ to shift the location of CG $\mathbf{46}_C$ forward or rearward, respectively.

In some implementations, sole $\mathbf{30}_C$ may provide ports or openings at each of locations $\mathbf{54}_T$, $\mathbf{54}_H$, $\mathbf{54}_F$, and $\mathbf{54}_H$ that may be sealed or covered with a cover, such as cover 44 in FIG. 5B, and a player may decide whether to insert a weight assembly including a tip plug into one or two of the openings corresponding to the positions at $\mathbf{54}_T$, $\mathbf{54}_H$, $\mathbf{54}_F$, and $\mathbf{54}_R$. In this regard, covers may be unscrewed from the openings in some implementations so that a tip plug housing and tip plug, or just a tip plug, can be inserted into the opening before the cover is screwed back onto the opening to secure the weight assembly. Alternatively, the cover may be secured to the opening by other known coupling means, such as with adhesives, magnets, clamps, and the like.

The foregoing use of weight assemblies as in FIGS. 5A to 6C can allow for a standard sized tip plug selected from a set of standard sized tip plugs having different masses to be used to customize the weight distribution of a golf club head and move the location of a CG for the club head. Those of ordinary skill in the art will appreciate with reference to the present disclosure that other implementations may include a different arrangement of components than those shown in FIGS. 5A to 6C. For example, other implementations may include a port or opening at a different location in a club head, such as in a rear portion of an iron club head that is opposite the striking face, that can receive a weight assembly including a tip plug housing and a tip plug.

Figure 7A:
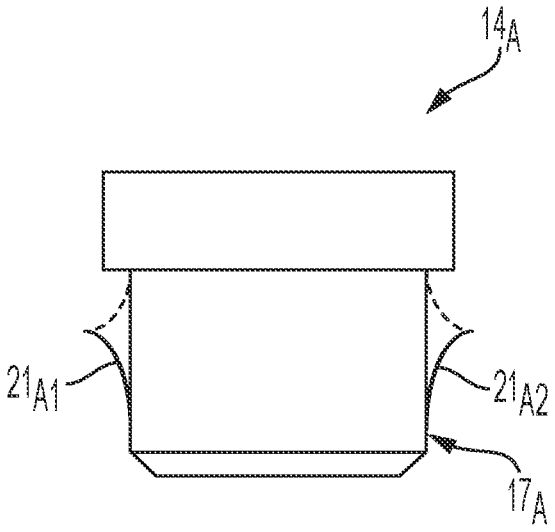
FIG. 7A is a front view of a tip plug housing including expansion members according to one or more embodiments.

FIG. 7A is a front view of tip plug housing $\mathbf{14}_A$ including expansion members $\mathbf{21}_A$ according to one or more embodiments. As shown in the examples of FIGS. 7A to 7C different types of protrusions from an exterior surface of the lower portion of a tip plug housing can be used to further secure the tip plug housing into a club shaft or into a club head.

In the example of FIG. 7A, expansion members $\mathbf{21}_{A1}$ and $\mathbf{21}_{A2}$ protrude from opposing sides of the exterior surface of lower portion $\mathbf{17}_A$ of tip plug housing $\mathbf{14}_A$. Expansion members $\mathbf{21}_{A1}$ and $\mathbf{21}_{A2}$ may have different shapes and may be made of the same material as the remainder of tip plug housing $\mathbf{14}_A$, such as a TPU material. For example, in some implementations, there may be a part of expansion members $\mathbf{21}_{A1}$ and $\mathbf{21}_{A2}$ that connect to lower portion $\mathbf{17}_A$ on an upper portion shown with the dashed lines in FIG. 7A, in addition to the lower portions of expansion members $\mathbf{21}_{A1}$ and $\mathbf{21}_{A2}$ shown in solid lines in FIG. 7A. In addition, other implementations may include a different number of expansion members, such as one expansion member $\mathbf{21}_A$ or four expansion members $\mathbf{21}_A$.

Figure 7B:
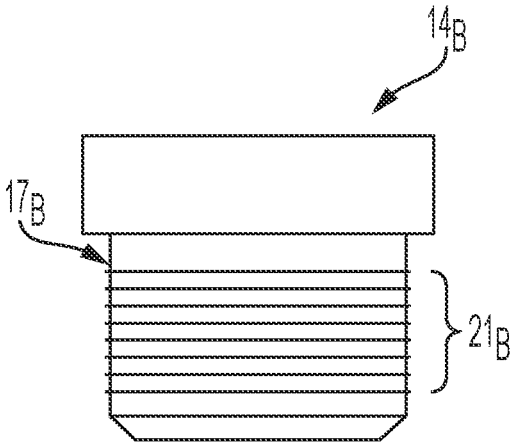
FIG. 7B is a front view of a tip plug housing including ribs according to one or more embodiments.

FIG. 7B is a front view of tip plug housing $\mathbf{14}_B$ including ribs $\mathbf{21}_B$ as protrusions from an exterior surface of lower portion $\mathbf{17}_B$ according to one or more embodiments. Ribs $\mathbf{21}_B$ may wrap around the circumference of lower portion $\mathbf{17}_B$ and provide a tighter fit into a butt end of a club shaft or into a club head, for example. Ribs $\mathbf{21}_B$ may be made of the same material as the rest of tip plug housing $\mathbf{14}_B$ in some implementations. Those of ordinary skill in the art will appreciate with reference to the present disclosure that other implementations of ribs $\mathbf{21}_B$ may differ, such as by having a different number or spacing of ribs, or by not completely encircling lower portion $\mathbf{17}_B$.

Figure 7C:
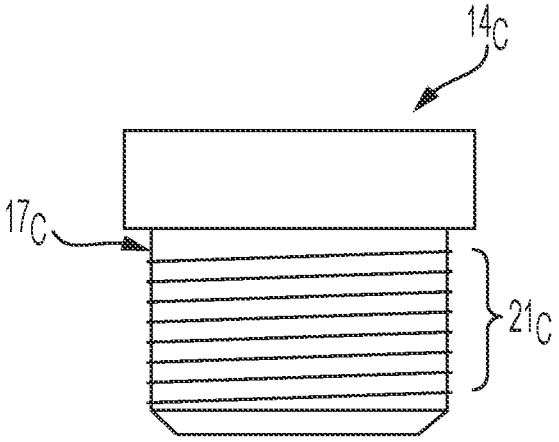
FIG. 7C is a front view of a tip plug housing including a threaded exterior surface according to one or more embodiments.

FIG. 7C is a front view of a tip plug housing $\mathbf{14}_C$ including a threaded exterior surface according to one or more embodiments. As shown in the example of FIG. 7C, threads $\mathbf{21}_C$ protrude from an exterior surface of lower portion $\mathbf{17}_C$ of tip plug housing $\mathbf{14}_C$ and can couple with female threading in the butt end of a club shaft and/or a club head to further secure tip plug housing $\mathbf{14}_C$ into the club shaft and/or club head. Threads $\mathbf{21}_C$ may be made of the same material as the rest of tip plug housing $\mathbf{14}_C$ in some implementations. Those of ordinary skill in the art will appreciate with reference to the present disclosure that other implementations of threads $\mathbf{21}_C$ may differ, such as by having a different pitch of threads.

Figure 8:
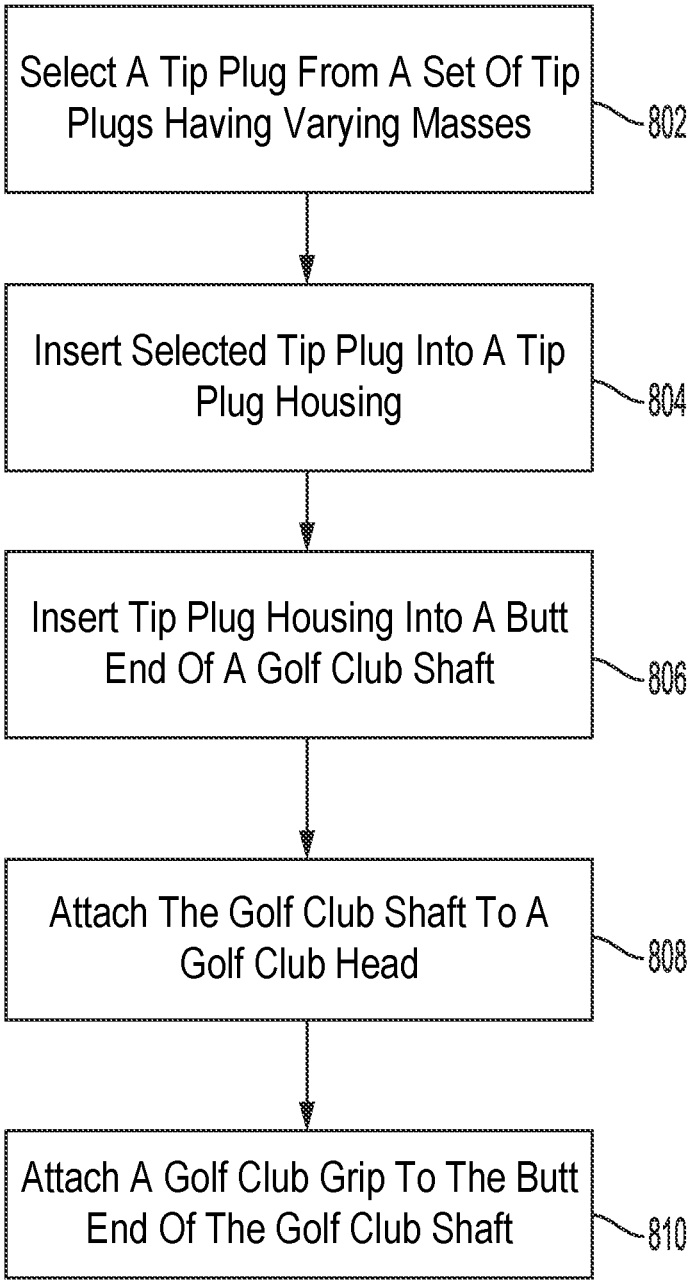
FIG. 8 is a flowchart for a golf club assembly process or weight distribution process according to one or more embodiments.

FIG. 8 is a flowchart for a golf club assembly or weight distribution process according to one or more embodiments. In some implementations, the process of FIG. 8 may be used in assembling a new golf club, such as by a manufacturer, to provide a particular swingweight for a golf club. The swingweight may be related to a golfer's swing speed and/or the type of golf club. As used herein, swingweight can refer to a measurement of a golf club's moment about a fixed fulcrum placed fourteen inches down the club shaft from the butt end of the grip. In this regard, one swingweight unit can equal 50 gram-inch for the moment about the foregoing location.

In some implementations, tip plugs of varying masses may be used in one or both of the butt and tip ends of a golf club shaft to provide a set of golf clubs, such as a set of irons, with either a uniform swingweight among the clubs in the set or to provide swing weights that vary proportionally with the lofts of the golf clubs in the set. In other implementations, the process of FIG. 8 may be performed after manufacture or an initial assembly to customize the weight distribution in a golf club, such as to modify the swingweight, mass, and/or balance point of the golf club.

In block 802, a tip plug is selected from a set of tip plugs that have varying masses and that are each sized to be insertable into a tip end of a golf club shaft. As discussed above, the set of tip plugs can have at least some dimensions that are the same or standard sized among the different tip plugs, such as an outer diameter for the heads of the tip plugs and an outer diameter for the stems of the tip plugs, for insertion into a tip end of a club shaft. The masses of the tip plugs in the set can vary based on the materials used for the tip plugs (e.g., plastic, brass, steel, or lead) and/or based on the lengths of the stems.

In some implementations, the tip plug can be selected to result in a swingweight closest to a final desired swingweight when inserted into the butt end of a club shaft with a tip plug housing. For example, the selection of a first tip plug can result in a first swingweight and the selection of a second tip plug can result in a second swingweight that is at least one swingweight unit less than the first swingweight. In other examples, the second swingweight can be at least two swingweight units less than the first swingweight, or the second swingweight can be at least three swingweight units less than the first swingweight. As discussed above the mass of the different tip plugs in the set of standard sized tip plugs can vary such that, for example, the first tip plug has a mass that is at least 3.5 g heavier than the mass of the second tip plug.

In other cases, the tip plug can be selected to result in a golf club mass closest to a final desired golf club mass when inserted into the butt end of a club shaft with a tip plug housing. In yet other cases, the tip plug can be selected to result in a golf club balance point closest to a final desired golf club balance point when inserted into the butt end of a club shaft with a tip plug housing.

In block 804, the selected tip plug is inserted into a tip plug housing, such as one of tip plug housings 14 discussed above. The tip plug can include a standard size or certain standard dimensions common among a set of tip plugs such that any one of the tip plugs from the set will fit into the tip plug housing. In some implementations, the tip plug may be secured in the tip plug housing with a frictional fit or press fit. Additionally or alternatively, an adhesive may be used to secure the tip plug into the tip plug housing, such as by applying tape across exposed surfaces of the top of the tip plug housing and the top of the tip plug head inside the tip plug housing.

In block 806, the tip plug housing including the tip plug inserted in block 804 is inserted into a butt end of a golf club shaft. The tip plug housing may be secured into the butt end of the shaft using a press fit or frictional fit, such as where the tip plug housing includes exterior surface protrusions as with expansion members $\mathbf{21}_A$ or ribs $\mathbf{21}_B$ in FIG. 7A or 7B, respectively. In other cases, a frictional fit of the tip plug housing into the butt end of the club shaft can include screwing the tip plug housing into the interior of the butt end, such as with threads $\mathbf{21}_C$ in FIG. 7C. In yet other implementations, an adhesive may be used to secure the tip plug housing into the butt end of the shaft, such as by using, for example, a double-sided tape affixed to an interior of the butt end of the club shaft that is folded over the top of the tip plug housing after insertion into the club shaft.

In block 808, the golf club shaft is attached to a golf club head, such as by press fitting or inserting the tip end of the club shaft into a hosel of the club head with an adhesive. In some implementations, such as where a previously assembled golf club is being modified, block 808 may be omitted.

In block 810, a golf club grip is attached to the butt end of the golf club shaft, which can further secure the tip plug housing to the club shaft. The club grip can be frictionally fit over the shaft and an exposed side circumference of the upper portion of the tip plug housing in some implementations.

Those of ordinary skill in the art will appreciate with reference to the present disclosure that the order of steps or blocks for the process of FIG. 8 can be in a different sequence. For example, the attachment of a golf club shaft to a golf club head in block 808 may occur before the insertion of a tip plug into a tip plug housing in block 804 or the insertion of a tip plug housing into a butt end of a club shaft in block 806. As another example variation, the insertion of a tip plug housing into the butt end of the club shaft in block 806 can occur before the insertion of a tip plug into the tip plug housing in block 804 in some implementations.

Figure 9:
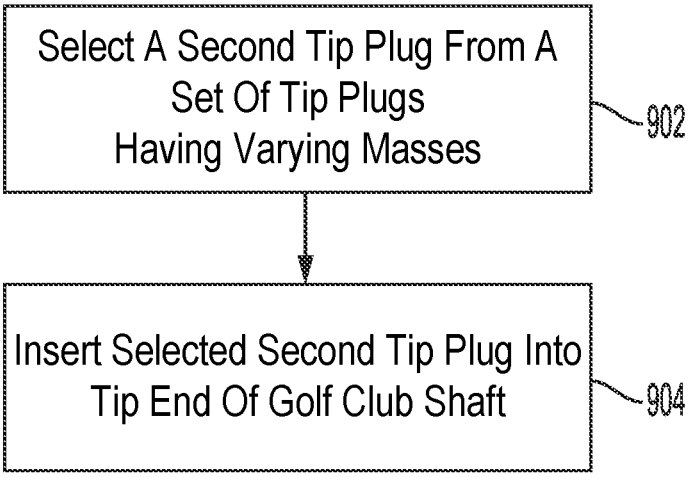
FIG. 9 is a flowchart for a tip end weight distribution process according to one or more embodiments.

FIG. 9 is a flowchart for a tip end weight distribution process according to one or more embodiments. The process of FIG. 9 can be performed as an optional sub-process in the golf club assembly or weight distribution process of FIG. 8, such as before the attachment of the golf club shaft to the golf club head in block 808 in FIG. 8. In other cases, the process of FIG. 9 can be performed independently of the process of FIG. 8, such as where a tip plug is only used in the tip end of the golf club shaft.

In block 902, a second tip plug is selected from a set of tip plugs having varying masses. In some implementations, the set of tip plugs can be the same set of tip plugs that is used to select a different or first tip plug from the set to insert into a different location, such as into a club head or into the butt end of a golf club shaft. As discussed above, the set of tip plugs can have at least some dimensions that are the same or uniform among the different tip plugs, such as an outer diameter for the heads of the tip plugs and an outer diameter for the stems of the tip plugs. The masses of the tip plugs in the set can vary based on the materials used for the tip plugs (e.g., plastic, brass, steel, or lead) and/or based on the lengths of the stems of the tip plugs. The mass and location of a first tip plug inserted into the butt end of the club shaft or into a club head may be considered when selecting a tip plug to insert into the tip end of the club shaft to achieve a final desired swingweight, a final desired golf club mass, and/or a final desired golf club balance point. In other implementations, the tip plug selected in block 902 may be the only tip plug inserted in the golf club.

In block 904, the tip plug selected in block 902 is inserted into the tip end of the golf club shaft. As noted above, the tip end of the club shaft is generally narrower and has a smaller inner diameter than the butt end of the club shaft. In this regard, a tip plug housing or adapter may not be needed if using a standard sized tip plug configured to fit into or insert into the tip end of the golf club shaft. However, the foregoing use of tip plug housings or adapters can advantageously enable the same tip plugs to be used in either the butt end or the tip end of a golf shaft. In addition, a standard sized tip plug may also be used in a golf club head to further simplify distributing weight in a golf club.

As discussed above, the foregoing use of golf tip plug housings or adapters can streamline the adjustment of weight distribution for a golf club so that separate sets of tip plugs or weights are not needed for the tip end of a club shaft, the butt end of a club shaft, and/or the golf club head. The tip plug housings of the present disclosure can allow for standard sized tip plugs, which can also lower the cost of adjusting the weight distribution of golf clubs. The housings or adapters can be implemented to streamline mass assembly. Alternatively, the housings or adapters can be implemented in a fitting studio to custom build golf clubs to a golfer's specifications.

The foregoing description of the disclosed example embodiments is provided to enable any person of ordinary skill in the art to make or use the embodiments in the present disclosure. Various modifications to these examples will be readily apparent to those of ordinary skill in the art, and the principles disclosed herein may be applied to other examples without departing from the scope of the present disclosure. For example, some alternative embodiments may include different materials, sizes, or shapes for golf club tips or golf club tip housings. Accordingly, the described embodiments are to be considered in all respects only as illustrative and not restrictive, and the scope of the disclosure is, therefore, indicated by the following claims rather than by the foregoing description. All changes which come within the meaning and range of equivalency of the claims are to be embraced within their scope. The described embodiments are to be considered in all respects only as illustrative and not restrictive. In addition, the use of language in the form of "at least one of A and B" in the following claims should be understood to mean "only A, only B, or both A and B."

The invention claimed is:

1. A golf club shaft assembly comprising:

a shaft having a tip end having an inner diameter and a butt end opposite the tip end having an inner diameter greater than the inner diameter of the tip end; and a tip plug housing securely positioned in the butt end of the shaft and having a lower portion with a lower portion inner diameter that is the same as the inner diameter of the tip end, wherein the tip end of the shaft and lower portion of the tip plug housing are configured to securely and interchangeably receive a stem of a tip plug having an outer diameter of either: (a) 7.0 mm to 7.6 mm or (b) 4.0 mm to 4.6 mm.

2. The golf club shaft assembly of claim 1, wherein the tip plug housing further comprises:

an upper portion having an upper outer diameter and upper inner diameter greater than the lower inner diameter; and a material chosen from the group consisting of: a plastic, a rubber, and an elastomer.

3. The golf club shaft assembly of claim 1, wherein the lower portion of the tip plug housing has an outer diameter no less than 13 mm.

4. The golf club shaft assembly of claim 2, wherein the upper portion of the tip plug housing has an outer diameter no less than 15 mm.

5. The golf club shaft assembly of claim 2, wherein the upper portion of the tip plug housing has a height no less than 2 mm.

6. The golf club shaft assembly of claim 5, wherein the upper portion height is no less than 1.5 mm.

7. The golf club assembly of claim 1, wherein an exterior surface of the tip plug housing comprises at least one protrusion.

8. The golf club shaft assembly of claim 1, wherein the tip plug housing further comrpises a material having a density no less than 1 g/cm$^3$.

9. The golf club assembly of claim 1, wherein the tip plug housing further comprises a mass no less than 1.0 g and no greater than 5.0 g.

10. The golf club shaft assembly claim 1, wherein a lower end of the golf tip plug housing includes an outer circumference that is beveled.

11. A golf club comprising:

a golf club head;

a golf club shaft having:

a tip end attached to the golf club head and having an inner diameter; and a butt end opposite the tip end having an inner diameter greater than the inner diameter of the tip end;

a grip installed over the butt end of the shaft;

a tip plug comprising a stem and a head located at one end of the stem, the tip plug stem having an outer diameter slightly smaller than the inner diameter of the tip end, wherein the stem is configured to be securably fit into the tip end of the shaft; and a tip plug housing having an outer diameter sized to be insertable in the butt end of the shaft and an inner diameter slightly larger than the outer diameter of the tip plug stem, wherein the tip plug housing inner diameter is configured to securely receive the tip plug stem, wherein the tip plug housing is positioned in the butt end of the shaft such that the tip plug stem is configured to be interchangeably positioned in either the tip end of the shaft or the tip plug housing.

12. The golf club of claim 11, wherein the tip plug comprises a material having a density no less than 5 g/cm$^3$.

13. The golf club of claim 12, wherein the tip plug comprises a material having a density no less than 8 g/cm$^3$.

14. The golf club of claim 13, wherein the tip plug comprises a material having a density no less than 11 g/cm$^3$.

15. The golf club of claim 11, wherein the tip plug is retained in the tip plug housing by a frictional fit.

16. The golf club of claim 11, wherein the tip plug housing is retained in the shaft by a frictional fit.

17. The golf club of claim 11, wherein the tip plug head has a head outer diameter greater than the stem outer diameter.

18. The golf club of claim 11, wherein the tip plug stem has a length no less than 1.5 mm and no greater than 25 mm.

19. The golf club of claim 11, wherein the golf club shaft comprises a graphite material and the stem outer diameter is no greater than 4.5 mm.

20. The golf club of claim 11, wherein the golf club shaft comprises a steel material and the stem outer diameter is no greater than 7.5 mm.

21. The golf club of claim 11, further comprising a second tip plug that is press fit into the tip end of the golf club shaft.

22. The golf club of claim 21, wherein the two tip plugs have a difference in mass.

23. The golf club of claim 21, wherein the two tip plugs have the same exterior dimensions.

* * * * *